United States Patent [19]

Ishimoto

[11] Patent Number: 4,571,213

[45] Date of Patent: Feb. 18, 1986

[54] DIRECTION-CONVERTING DEVICE FOR A TOY CAR

[75] Inventor: Zenichi Ishimoto, Tokyo, Japan

[73] Assignee: Nikko Co., Ltd., Tokyo, Japan

[21] Appl. No.: 640,960

[22] Filed: Aug. 15, 1984

[30] Foreign Application Priority Data

Nov. 17, 1983 [JP] Japan ..... 58-176734[U]
Nov. 17, 1983 [JP] Japan ..... 58-176735[U]

[51] Int. Cl.[4] ..... A63H 17/36

[52] U.S. Cl. ..... 446/468; 446/129; 446/456; 446/460

[58] Field of Search ..... 446/468, 454, 456, 436, 446/437, 465, 460, 129; 335/230

[56] References Cited

U.S. PATENT DOCUMENTS

| | | | |
|---|---|---|---|
| 4,163,341 | 8/1979 | Jones et al. | 446/468 |
| 4,207,502 | 6/1980 | Omura | 446/454 |
| 4,254,577 | 3/1981 | Cheng | 446/460 |
| 4,286,244 | 8/1981 | Schuessler | 335/230 |
| 4,387,357 | 6/1983 | Mandel et al. | 335/272 |
| 4,471,566 | 9/1984 | Ishimoto | 446/460 |
| 4,479,103 | 10/1984 | Bailey et al. | 335/230 |

*Primary Examiner*—Robert A. Hafer
*Assistant Examiner*—Daniel Nolan

[57] ABSTRACT

A direction-converting device for a toy car is disclosed, in which the toy car is provided with an electromagnet having an exciting iron core with its opposite sides being energizable to different polarities and a magnet having opposite end faces with different polarities, in which one core portion of the electromagnet at its free end has a width equal to or larger than a width of the opposed end of the magnet, and in which the electromagnet or the magnet is fixed to one end of a controlling element which in turn is arranged at a middle portion of a steering element. The one core portion of the electromagnet may be divided into two portions, between which is arranged another magnet.

Thus, the device ensures a neutral position of the steering element reliably in the deenergized state of the electromagnet.

8 Claims, 4 Drawing Figures

FIG. 1(a)
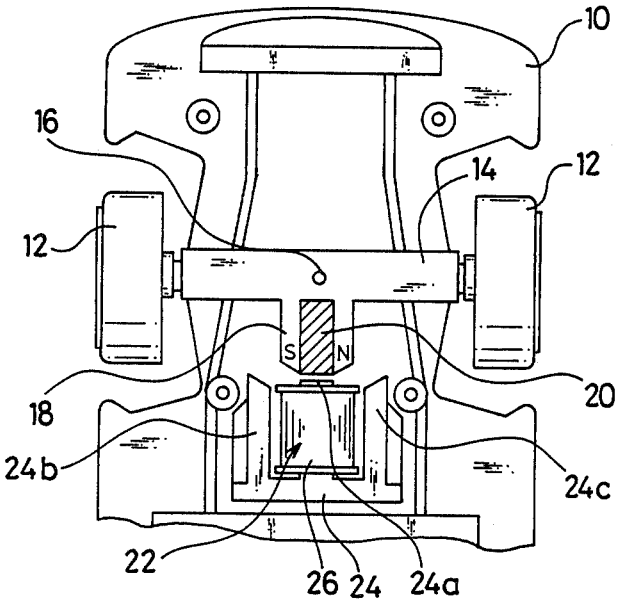
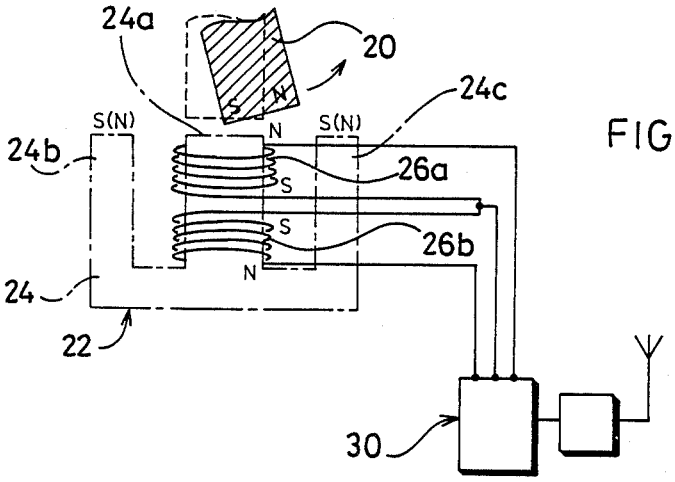
FIG. 2(a)

FIG. 1(b)
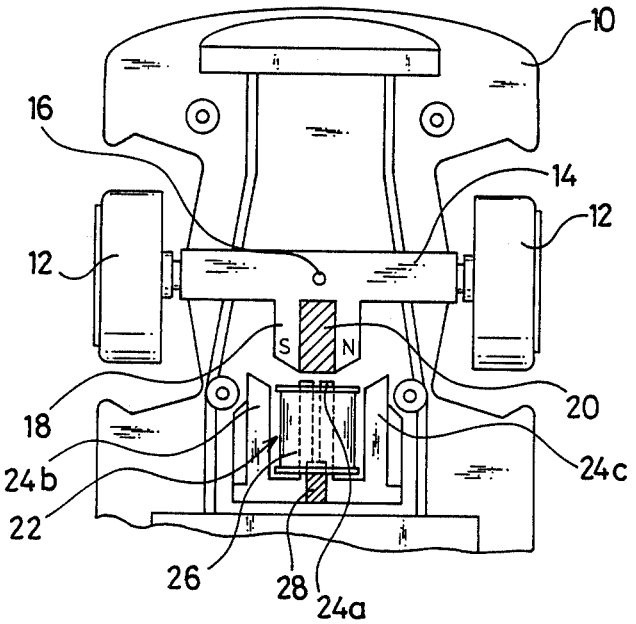
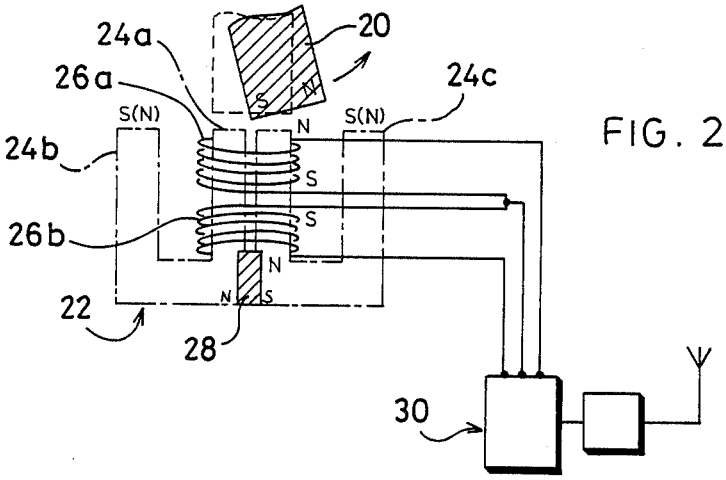
FIG. 2(b)

DIRECTION-CONVERTING DEVICE FOR A TOY CAR

FIELD OF THE INVENTION

This invention relates to a direct-converting device for a toy car by means of a radio-controlling system.

BACKGROUND OF THE INVENTION

As a direction converting device for the running car racer, there has already been known a device in which a steering plate mounted on front wheels is turned to the left or the right through a worm gear mechanism by reversible operation of a servo-motor for converting the direction of the front wheels to the straight, the right or the left.

In the conventional direction converting device, however, frequent changes in direction of the car racer may require the corresponding frequent reverting operations of the servo-motor, thereby generating sparks at various contacts forming an electrical system of the servo-motor. Such sparks in the servo-motor may cause damage of the electrical system of the servo-motor and erroneous operation of the wireless controller. In particular, the servo-motor is disadvantageous in high cost for its excellent control performance and in more increased cost for designing a control circuit to avoid the sparks.

In view of the foregoing, the applicant has already devised a direction-converting device which comprises an electromagnet energizable to a desired polarity each time and at least a pair of magnets symmetrically arranged on a car body and maintained at different polarities from each other, said eletromagnet or said pair of magnets being secured to one end of a controlling element arranged swingably in a horizontal plane, said controlling element being engaged with a steering plate connected to wheels, and filed therefor the U.S. patent application on Jan. 6, 1982, under U.S. Pat. Ser. No. 337,500 , which application issued to U.S. Pat. No. 4,471,566 on Sept. 18, 1984. Thus, either one of the magnets on the controlling element is attracted to the electromagnet for shifting the controlling element to the desired direction, depending on the energized state of the electromagnet.

The direction-converting device according to the U.S. Pat. Ser. No. 337,500 comprises combination of the electromagnet and the magnets, so that it may be simple in construction, very low in manufacturing cost, free of erroneous operation of the wireless controller, and steady and reliable in the direction control. In such direction-converting device, however, the wheels should be desirably maintained in the neutral position, namely in their straight-running position upon deenergizing the electromagnet. For this purpose, according to the device of the U.S. Pat. Ser. No. 337,500, a pair of supporting rods are arranged symmetrically to a shaft supporting the controlling element. The supporting rods at their ends are pivoted to the car base while at their middle parts are connected elastically with a spring, and their swingable ends are engaged with a stopper protruded from the controlling element for keeping the stopper at its predetermined neutral position. Thus, the construction of the controlling element is somewhat disadvantageously complicated.

SUMMARY OF THE INVENTION

Accordingly, a general object of the invention is to provide a direction-converting device in which the neutral position retaining means may be simplified for improving the controlling performance of the device and reducing its manufacturing cost.

A principal object of the invention is to provide a direction-converting device for a toy car, which comprises an electromagnet having an exciting iron core with its opposite sides being energizable to different polarities directed to the same direction, and a magnet having opposite end faces with different polarities, said electromagnet being arranged oppositely to said magnet on a car base, one core portion of said electromagnet at its free end having a width equal to or larger than a width of the opposed end of said magnet, said electromagnet or said magnet being fixed to one end of a controlling element which in turn is arranged at a middle portion of a steering element swingably secured to the car base.

PREFERRED EMBODIMENTS OF THE INVENTION

In accordance with the invention, the steering element is provided integrally with the controlling element, operation of which is transmitted directly to the steering element and, if desired, the electromagnet is provided with an additional magnet for obtaining a certain magnetic force even on the deenergized state, thereby to achieve simplification of the controlling element, as well as stability and reliability of the steering operation.

Thus, in accordance with the invention, the electromagnet has preferably an E-shaped iron core, a center core portion of which is provided with an exciting coil and arranged oppositely to the magnet.

Further, in accordance with the invention, the one core portion (or preferably the center core portion of the E-shaped iron core) of the electromagnet is divided into two portions having different polarities, between which is arranged another magnet.

The electromagnet on its exciting core may be provided with a double-winding coil for obtaining the different polarities. Alternatively, the electromagnet may be provided with a single-winding coil, which is energizable to reverse the polarity.

In accordance with the invention, the electromagnet is preferably fixed to the car body while the magnet is preferably fixed to one end of the controlling element for ensuring a neutral position of the steering element through an attractive relation between the magnet and the iron core of the electromagnet in the deenergized state of the latter.

The direction-converting device according to the invention may be constructed as a radio-controlling system.

The invention will be described in more detail hereinbelow for its preferred embodiments with reference to the accompanying drawings.

BRIEF DESCRIPTION OF THE DRAWINGS

FIGS. 1(*a*) and 1(*b*) show main portions of the car structure having the direction-converting device according to the invention; and FIGS. 2(*a*) and 2(*b*) show the operation of the controlling element and the controlling mechanism of the electromagnet.

DETAILED DESCRIPTION OF THE INVENTION

FIGS. 1(*a*) and 1(*b*) show the embodiments of the direction-converting device useful in the radio-controllable toy car.

Referring to FIGS. 1(*a*) and 1(*b*), a numerical reference 10 represents a front portion of a car base while a reference 12 represents wheels. A pair of wheels 12, 12 are coupled to both ends of a steering element 14. Thus, in the illustrated embodiments, turn of the steering element 14 to the left enables the wheels 12, 12 to be directed to the left. The steering element 14 is pivoted at its middle portion to a shaft 16 projected from the car base 10 and is provided integrally with a controlling element 18 on which is fixed a magnet 20. On the other hand, an electromagnet 22 is fixed to the car base 10 and is positioned oppositely to the magnet 20 on the controlling element 18.

The electromagnet 22 preferably comprises an E-shaped exciting iron core 24 and a coil 26 wound on a center core portion 24*a* of the E-shaped core 24 with outer core portions 24*b*, 24*c* having a polarity different from the center core portion 124*a*. The center core portion 124*a* of the exciting iron core 24 may be divided into two portions having different polarities, between which is arranged another magnet 28 [see FIG. 1(*b*)]. Further, the center core portion 24*a* at its free end has a width equal to or larger than a width of the opposed end of the magnet 20, thereby to improve the operation for restoring the controlling element 18 to the neutral position. The magnet 20 is provided at its either side with different polarities.

Thus, in accordance with the invention, the iron core 24 of the electromagnet 22 may be excited in the different polarity, while the magnet 20 on the controlling element 18 may be directly opposed to the center core portion 24*a* of the exciting iron core 24 when the steering element 14 is restored to its neutral position. If, for example, the magnet 20 has the illustrated polarity and the coil 26 is energized to impart the N polarity to center core portion 24*a* of the electromagnet 22, the magnet 20 at its S and N polarity sides may be in the attractive relation to the core portions 24*a*, 24*c*, respectively, of the electromagnet 22, while the magnet 20 at its S polarity side may be in the repulsive relation to the core portion 24*b* of the electromagnet 22, thereby to allow the controlling element 18 to swing on the shaft 16 to the left, as shown in FIG. 2. On the other hand, if the coil 26 is energized to impart the S polarity to the center core portion 24*a* of the electromagnet 22, the magnet 20 at its N and S polarity sides may be in the attractive relation to the core portions 24*a*, 24*b*, respectively, of the electromagnet 22, while the magnet 20 at its N polarity side may be in the repulsive relation to the core portion 24*c*, thereby to allow the controlling element 18 to swing on the shaft 16 to the right. In accordance with the embodiment as shown in FIG. 2(*b*), when the coil 26 is energized, the center core portion 24*a* retains either one polarity due to cancellation of the exciting action of the magnet 28 arranged between the divided center core portions.

Thus, in accordance with the invention, the shift of the energized state of the electromagnet 22 enables the wheels 12, 12 to turn to the left or the right. When the electromagnet 22 is deenergized, the magnet 20 of the controlling element 18 may be in the attractive relation to the non-exciting center core portion 24*a* of the electromagnet 22, thereby to allow the controlling element 18 and the steering element 14 to be restored to their neutral position, as shown in FIG. 1(*a*). Alternatively, upon deenergization of the electromagnet 22, the non-exciting center core portion 24*a* at its divided ends may retain the different polarities through the magnet 28 and thus may be in the attractive relation to the magnet 20 of the controlling element 18, thereby to allow the latter and the steering element 14 to be restored more reliably to the neutral position, as shown in FIG. 1(*b*).

The direction-converting device thus constructed may preferably applied to any toy car having a radio-controlling system. In this case, the electromagnet 22 may comprise a pair of coils 26*a*, 26*b* wound on the center core portion 24*a*, as shown in FIG. 2, in order to provide the current flows in the opposite directions. Upon receiving a given instruction signal through a wireless receiver 30, one of the coils 26*a*, 26*b* is connected to a power source thereby to shift the polarity of the exciting iron core 24 depending on the nature of each coil 26*a*, 26*b* and to provide an effect on the magnet 20 of the controlling element 18. Consequently, two different instruction signals from a wireless transmitter (not shown) may shift the polarity of the exciting iron core 24 of the electromagnet 22, thereby to control the tuning direction of the wheels 12, 12 to the left or the right. Upon deenergization of the electromagnet 22, the magnet 20 of the controlling element 18 may be in the attractive relation to the center core portion 24*a* of the electromagnet 22, enabling the controlling element 18 and the steering element 14 to be restored immediately to their neutral position, thereby to retain the straight running of the wheels 12, 12.

Alternatively, the electromagnet 22 may be provided at its part of the iron core 24 with a single coil, rather than the double coil, which is energizable to reverse the polarity through the wireless receiver 30.

It will be appreciated from the foregoing that the device according to the invention comprises a combination of the electromagnet and the magnet in a simple construction, so that very low manufacturing cost, convenient operation of the radio-controller, avoidance of the malfunction, as well as stable and reliable direction-converting control may be achieved. In accordance with the invention, the controlling element is integrated with the steering element, so that the construction of the steering element may be considerably simplified and the retoration of the steering element to the neutral position may be readily and reliably ensured upon deenergization of the electromagnet.

In the embodiments as described hereinabove, the controlling element is provided with the magnet. Alternatively, the controlling element may be provided with the electromagnet, while the magnet may be fixed to the car base in the location opposite to the electromagnet in order to obtain the same effect as in the previous embodiments.

Further, the exciting iron core of the electromagnet may be modified so as to omit one of the outer core portions, namely to form a U-shaped iron core, for controlling the turning direction of the steering element only in one way to either the left or the right.

Although the invention has been described hereinabove with its preferred embodiments, it will be appreciated that many variations and modifications may be made without departing from the spirit and scope of the invention.

What is claimed is:

1. A direction-converting device having a neutral position-restoring and position-retaining function for a toy car having a horizontal base, which comprises an electromagnet means having an excitable iron core with its opposite sides being energizable to different polarities directed to the same direction, and a permanent magnet means having opposite end faces with different polarities, said electromagnet means being disposed oppositely to said magnet means on said car base, one core portion of said electromagnet means at its free end having a width equal to or larger than the width of the opposed end of said permanent magnet means, one of said magnet means being fixed to one end of a controlling element arranged at a mid portion of a steering element swingably secured to the car base, the other magnet means being fixed to the car base, said electromagnet means and said permanent magnet means being arranged so that the neutral position of said steering element may be restored and retained through an attractive relation between said permanent magnet means and said one core portion of the electromagnet means upon deenergization of the latter.

2. The direction-converting device according to claim 1, wherein the electromagnet means has an E-shaped iron core, a center core portion of which is provided with an exciting coil and arranged oppositely to the permanent magnet means.

3. The direction-converting device according to claim 1, wherein said one core portion of the electromagnet means is divided into two portions, between which is arranged another magnet.

4. The direction-converting device according to claim 3, wherein the electromagnet means has an E-shaped iron core, a center core portion of which is provided with an exciting coil and arranged oppositely to the magnet, said center core portion being divided into two portions with different polarities, between which is arranged said another magnet.

5. The direction-converting device according to claim 1, wherein the electromagnet means has a double coil wound on the excitable iron core for providing different polarities.

6. The direction-converting device according to claim 1, wherein the electromagnet means has a single coil wound on the excitable iron core, which coil is energizable to reverse the polarity.

7. The direction-converting device according to claim 1, wherein the electromagnet means is fixed to the car base while the permanent magnet means is fixed to one end of the controlling element.

8. The direction-converting device according to claim 1, wherein the coil of the electro-magnet means is energized or deenergized by a radio-controlling system.

* * * * *